US008013296B2

(12) United States Patent
Wollnik et al.

(10) Patent No.: US 8,013,296 B2
(45) Date of Patent: Sep. 6, 2011

(54) CHARGED-PARTICLE CONDENSING DEVICE

(75) Inventors: Hermann Wollnik, Fernwald (DE); Yoshihiro Ueno, Uji (JP)

(73) Assignee: Shimadzu Corporation, Tokyo (JP)

( * ) Notice: Subject to any disclaimer, the term of this patent is extended or adjusted under 35 U.S.C. 154(b) by 110 days.

(21) Appl. No.: 12/600,741

(22) PCT Filed: May 21, 2007

(86) PCT No.: PCT/JP2007/060750

§ 371 (c)(1),
(2), (4) Date: Nov. 18, 2009

(87) PCT Pub. No.: WO2008/142801

PCT Pub. Date: Nov. 27, 2008

(65) Prior Publication Data

US 2010/0148062 A1 Jun. 17, 2010

(51) Int. Cl.
*H01J 49/04* (2006.01)
*H01J 49/06* (2006.01)

(52) U.S. Cl. ..... 250/288; 250/281; 250/286; 250/296; 250/396 R

(58) Field of Classification Search ..... 250/288, 250/281, 286, 296, 396 R
See application file for complete search history.

(56) References Cited

U.S. PATENT DOCUMENTS

| | | | | |
|---|---|---|---|---|
| 6,107,628 | A * | 8/2000 | Smith et al. | 250/292 |
| 6,818,889 | B1 * | 11/2004 | Sheehan et al. | 250/288 |
| 6,949,740 | B1 * | 9/2005 | Sheehan et al. | 250/288 |
| 2003/0089846 | A1 | 5/2003 | Cooks et al. | |
| 2004/0245457 | A1 | 12/2004 | Granger et al. | |
| 2004/0245458 | A1 * | 12/2004 | Sheehan et al. | 250/288 |

FOREIGN PATENT DOCUMENTS

| | | | |
|---|---|---|---|
| CN | 1585081 | A | 2/2005 |
| CN | 1695218 | A | 11/2005 |
| JP | 07-068517 | A | 3/1995 |
| JP | 08-304342 | A | 11/1996 |
| WO | 2004/021385 | A2 | 3/2004 |
| WO | 2005/119737 | A1 | 12/2005 |

OTHER PUBLICATIONS

Chinese Office Action dated Dec. 21, 2010 for corresponding application.

* cited by examiner

*Primary Examiner* — Nikita Wells
(74) *Attorney, Agent, or Firm* — Sughrue Mion, PLLC

(57) ABSTRACT

Ions and charged droplets move from the nozzle (6) towards the orifice (22) of a charged-particle transport device or the desolvation pipe (7). This particle motion is governed by the distribution of the pseudo-potential along particle trajectories. There are RF-voltages applied to neighboring electrodes (241-246) of the electrode array (24) cause the charged particles to substantially hover above the electrode array (24). Right before the ions come to the electrode array (24) they thus experience a repelling force "F" perpendicular to the surface of the electrode array (24). This force "F" causes an effective barrier (B) right before the electrode array (24) and consequently a pseudo-potential well (A) where the charged particles stop their motion parallel to the plume axis (D). Thus they accumulate around the center line (C) of this well (A). Applying additionally to the RF-potentials also DC-potentials to neighboring electrodes within the electrode array (24) small DC-fields can be formed within the well area (23). These additional DC-fields drive the charged particles towards the axis of symmetry (C) and thus towards the orifice (22) of a charged-particle transport device or the desolvation pipe (7). Thus, many of the charged particles which would normally impinge on the wall (21) around the orifice (22) can now be analyzed.

37 Claims, 17 Drawing Sheets

CHARGED-PARTICLE CONDENSING DEVICE

TECHNICAL FIELD

The present invention relates to a mass spectrometer, and more specifically to the ion source of such a spectrometer that forms a cloud of ions or other charged particles which must be extracted through a small orifice into a mass spectrometer or mobility spectrometer with the ions or other charged particles being formed in a gas of approximately one or a few atmospheres, as is done in an electrospray ion source (ESI), an atmospheric pressure chemical ion source (APCI), a high-frequency inductively coupled plasma ion source (ICP), or alternatively in a gas of reduced pressure as is done in an electron impact ion source (EI), a chemical ion source (CI), a laser ion source (LI) or a plasma ion source (PI).

BACKGROUND ART

To ionize molecules or atoms for the analysis in a mass spectrometer or a mobility spectrometer different ionization techniques are employed. Many of these techniques provide ions within a cloud from which only those can be investigated that enter the mobility spectrometer or the mass spectrometer through some narrow orifice. In some cases a double ion analysis is required and the ions must be introduced through a small orifice into a mobility spectrometer at approximately atmospheric gas pressure and then from the exit of this mobility spectrometer through another small orifice into an evacuated mass spectrometer. To guide ions through one or through several small orifices is always difficult to achieve so that commonly a large percentage of the formed ions will impinge on the sides of said orifice and be lost for the analysis When ions are formed in gas at a pressure that is higher than the pressure in the mobility spectrometer or mass spectrometer the effect of the gas flow into this ion analyzer must be taken into account also. Thus, orifices are often formed as a skimmer that has sharp edges mainly because this reduces the effects of gas turbulence.

Representative atmospheric pressure ionization is achieved in an "atmospheric pressure electrospray ionization" (ESI) or an "atmospheric pressure chemical ionization" (APCI). In the ESI method a voltage of several kV is applied to the nozzle of a capillary to which a liquid sample is applied. At this nozzle small charged droplets are formed from which the solvent evaporates quickly leaving portions of the droplet charge on the initially dissolved molecules. In the APCI method a needle is aligned to this nozzle that initiates a corona discharge which ionizes atoms or molecules of the carrier gas which after a very short time transfer their charge to molecules of interest. In both methods often the nozzle and/or the carrier gas is heated so as to enhance the evaporation rate of the droplets since still intact droplets would be detrimental to the functioning of the mobility spectrometer or the mass spectrometer.

In case the ions are introduced into an evacuated mass spectrometer the gas flow should be reduced so much that the pumping capacity suffices. This can be achieved for instance by a straight or curved capillary (see Patent Document 1) which can also be heated in order to assist the evaporation of residual droplets. However, in most cases only a portion of the formed ions enter the capillary and even of these many will interact with the walls of the capillary and thus be lost. Some improvement of this method is obtained when this capillary is replaced by a skimmer or sampling cone (see Patent Document 2). In both methods, however, only a portion of the formed ions can be utilized.

In order to increase the ion transmission into the evacuated mass spectrometer also configurations have been used (Patent Documents 3, 4 and 5) in which not a single but several apertures were used.

[Patent Citation 1] Japanese Unexamined Patent Application Publication No. H7-68517
[Patent Citation 2] Japanese Unexamined Patent Application Publication No. H8-304342
[Patent Citation 3] U.S. Pat. No. 6,818,889
[Patent Citation 4] U.S. Pat. No. 6,949,740
[Patent Citation 5] U.S. Patent Application Publication No. 2004/0245458

DISCLOSURE OF INVENTION

Technical Problem

In the present invention an ion condensing device is described which improves the sensitivity of a mobility spectrometer or a mass spectrometer by increasing the efficiency of ion introduction through a small orifice. This is achieved by providing specific RF and DC electric fields in the region of the initial ion cloud whereby the RF-fields keep the ions and other charged particles from reaching walls in this region and the superimposed DC-fields push them toward said orifice.

Technical Solution

The device described in the present invention, that condenses the ions to a small cloud, consists of a plurality of narrowly spaced electrodes arranged on a surface substantially around a circular or elongated orifice. The orifice in this surface can be that orifice through which the ions formed in the ionization chamber enter a mobility spectrometer or a mass spectrometer. Instead of using the condensing effects of electrode arrays on a single surface one can also use the combined action of electrode arrays on two or more surfaces arranged such that their orifices are approximately aligned and the ions can pass through all of them. However, the alignment may not be strictly concentric and the shape of the orifices may not be strictly circular.

Applying RF-voltages to neighboring electrodes on at least one array the RF-fields push the ions back and forth between neighboring electrodes with the electric field changing its direction so quickly that the ions cannot reach either one of them and thus hover above the electrode array in some effective pseudopotential well indicated in FIG. 1. Applying additionally to these RF-voltages also small DC-voltages to neighboring electrodes the corresponding DC-fields push the ions towards said orifice through which the ions must pass to enter said mass spectrometer or mobility spectrometer. Using numerical calculations this overall ion motion is illustrated for two ions in FIG. 19.

In some ion sources not only ions are formed but also undesired large droplets or ion clusters. When ions are accelerated towards said orifice they form some relatively wide plume, as is illustrated in FIG. 1, while the droplets and clusters usually are concentrated in the middle of this plume. Thus it can be of advantage to direct at least some of these particles away from said orifice. How this can be achieved practically is illustrated in FIG. 2 and FIG. 3.

In a first embodiment of the ion condensing device described in the present invention said electrodes are configured as substantially concentric ring electrodes, as is shown in FIGS. 4, 5, 12, 14, 15 and 16. Applying to these electrodes superimposed RF- and DC-potentials, fields can be formed that trap the ions in a volume in front of the electrode array and push them radially towards said orifice. In all cases the electrode widths as well as their separations can vary within one electrode array (see FIG. 4) or in case several electrode arrays are used from one array to the next (see FIG. 5).

In a second embodiment of the ion condensing device described in the present invention said electrodes are configured to be substantially straight and substantially parallel as is shown in FIGS. 6, 7, 13 and 17. Applying to these electrodes superimposed RF- and DC-potentials, fields can be formed within the trapping region in front of the electrode array that act perpendicular to the electrodes and thus move the ions towards an elongated orifice. By accelerating the ions that have passed through this orifice towards a second such electrode array of substantially straight and substantially parallel electrodes that are orientated under some angle, for instance 90-degrees, relative to the first electrode array, the elongated ion cloud can be condensed to cloud of small volume.

Since the amplitudes of the RF-fields are always limited only those ions are pushed back from the surface of an electrode array whose velocity "v" stays below a certain value. Actually only the velocity component perpendicular to the surface of the electrode array, i.e. $v_{\perp}=v\cos(\alpha)$ must remain below this value, where $\alpha$ is the angle between the normal to the surface of said array and the ion trajectory. Thus it is helpful to increase the angle "$\alpha$" as is shown in FIG. 3 and FIG. 7.

In most cases the overall number of ions extracted from a source depends on the applied electric field. In the case of an electrospray ion source this is the field in the region of the nozzle shown in FIG. 1. This field, however, also influences the field everywhere in the ionization chamber and thus often increases the velocity "v" of the ions approaching the electrode array and said orifice. Thus it is advantageous to use grids or diaphragms as shown in FIG. 10 and FIG. 11 and to apply to them DC-potentials to reduce the velocity of the ions when they approach the electrode array.

In many atmospheric pressure ion sources there is also some gas stream that pushes the ions towards said orifice and thus also towards said electrode arrays. This addition to the ion velocity "v" cannot be influenced by electric fields. One can, however, form at least one of said diaphragms such that it skims a portion of the gas off and one can furthermore shape at least one of said diaphragms such that it redirects a portion of the gas stream, a measure that can be assisted by strategically arranged exhaust ports.

Advantageous Effects

According to the present invention the ions generated in an ionization chamber are guided by electric RF- and DC-fields together with other charged particles towards an orifice through which they must pass to enter the mass spectrometer or the mobility spectrometer. This includes many ions which otherwise would have been lost because they would have impinged on surfaces. Consequently the utilization efficiency of the formed ions is increased significantly and the ion intensity in the finally recorded mobility spectrum or mass spectrum is improved and thus is the sensitivity of the performed measurement.

In the embodiment in which RF- and DC-potentials of proper magnitude have been applied to a plurality of substantially circular and substantially concentric electrodes one finds that ions together with other charged particles are trapped in a broad region above the electrode array and guided towards said orifice placed in the center of the electrode array.

In the embodiment in which RF- and DC-potentials of proper magnitude have been applied to a plurality of substantially parallel electrodes one finds also that ions together with other charged particles are trapped in a broad region above the electrode array. However, this electrode array will guide them only in a direction perpendicular to the orientation of said electrodes. Passing them through an elongated orifice and accelerating them towards a second such array of substantially parallel electrodes that are oriented orthogonally to the first array the ions are condensed to a narrow cloud that efficiently can be extracted through said orifice.

When ions reach the trapping region above said substantially circular or substantially parallel electrode arrangements, the velocity "v" of these ions or other charged particles can be so high that the effective repelling force "F" caused by the RF-fields is too small to trap them. Using intermediate grids and diaphragms and applying to them retarding potentials their velocity "v" can be reduced sufficiently.

The trapping efficiency of the RF-fields increases with the mass of the ions under consideration and the magnitude of the RF-fields. Thus it can be of advantage to choose the magnitude of the RF-fields such that ions or other charged particles of interest are well trapped while lighter ones of no interest are not trapped and thus impinge on the electrode array. At least some of the undesired particles thus are not transmitted into the mass spectrometer or the mobility spectrometer and consequently improve the selectivity of the ion analysis.

BRIEF DESCRIPTION OF DRAWINGS

FIGS. 1(*b*) and 1(*c*) are diagrams of the potential distributions along the bottom C of the pseudopotential well and along a particle trajectory projected onto the axis D.

EXPLANATION OF REFERENCE

1 . . . Ionization Chamber of FIGS. 8 and 9
2 . . . Chamber for Mobility Spectrometer of FIG. 9
3 . . . First Intermediate Vacuum Chamber of FIGS. 8 and 9
4 . . . Second Intermediate Vacuum Chamber of FIGS. 8 and 9
5 . . . Chamber for Mass Spectrometer of FIGS. 8 and 9
6 . . . Nozzle of FIGS. 1, 2, 3, 10 and 11
7 . . . Desolvation Pipe or Charged-Particle Transport Device of FIGS. 1, 2, 3, 10 and 11
8 . . . Exhaust of Ionization Chamber in FIGS. 8 and 9
9 . . . Lens in Chamber 2 to Focus Ions into Mobility Spectrometer in FIG. 9
10 . . . Mobility Spectrometer in FIG. 9
11 . . . Detector for Mobility Spectrometer of FIG. 9
12 . . . Pump of Chamber for Mobility Spectrometer of FIG. 9
13 . . . Lens in Chamber 3 to Focus Ions into Skimmer of FIGS. 8 and 9
14 . . . Skimmer of FIGS. 8 and 9
15 . . . Pump of Chamber 3 of FIGS. 8 and 9
16 . . . Lens in Chamber 4 to Focus Ions into Orifice for Mass Spectrometer of FIGS. 8 and 9
17 . . . Pump of Chamber 4 of FIGS. 8 and 9
18 . . . Quadrupole Mass Spectrometer of FIGS. 8 and 9
19 . . . Ion Detector for Mass Spectrometer of FIGS. 8 and 9
20 . . . Pump of Chamber for Mass Spectrometer of FIGS. 8 and 9
21 . . . Wall behind Electrode Array of FIGS. 1, 2, 3, 10 and 11
22 . . . Aperture of Desolvation Pipe or Others of FIGS. 1, 2, 3, 10 and 11
23 . . . Ion Trapping Region of FIGS. 1, 2, 3, 10 and 11
24 . . . Electrode Array of FIGS. 1, 2, 3, 10 and 11
241-248 . . . Electrodes on Surface 1 of FIGS. 1, 2, 3, 4, 5, 6, 7, 10 and 11
251-256 . . . Electrodes on Surface 2 of FIGS. 5, 6 and 7
26 . . . Shielding Grid of FIG. 10
271, 272, 273 . . . Shielding Diaphragms of FIG. 11
281, 282, 283 . . . Spiral-like Electrodes of FIGS. 15 and 16
291, 292, 293 . . . Meander-like Electrodes of FIG. 17

BEST MODE FOR CARRYING OUT THE INVENTION

The present invention aims to improve the coupling efficiency of an atmospheric pressure ion source to a mass spectrometer or to a mobility spectrometer by providing electric fields that act as a condensing device for charged particles before they are fed to the spectrometer. A complete such system is illustrated with all its essential parts in FIGS. 8 and 9.

Figure 8:
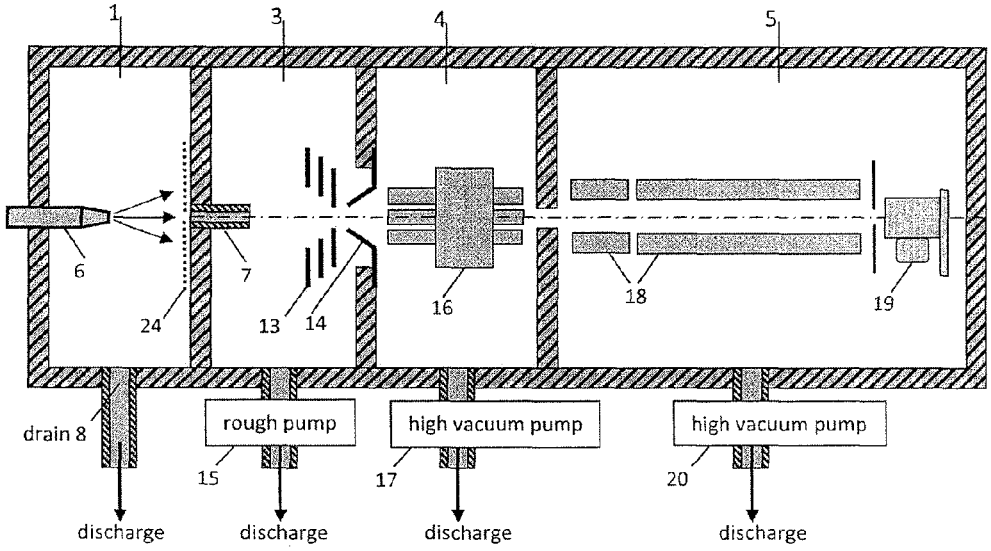
FIG. 8 illustrates the entire configuration of an atmospheric pressure ionization mass spectrometer including two chambers for differential pumping.

A mass spectrometer that is equipped with an atmospheric pressure ion source is illustrated in FIG. 8. There is an ionization chamber (1) that features a nozzle (6) into which molecules of interest are introduced dissolved in a liquid sample or in the effluent of a liquid chromatograph, not shown. From this nozzle charged droplets emerge from which ionized molecules evaporate as well as neutral molecules that either stay uninvestigated or must be ionized by electric discharges or laser interaction. This evaporation of droplets is enhanced when the droplets pass into the usually heated so-called desolvation pipe (7). The neutral molecules as well as the nebulizing gas, not shown, fill the ionization chamber (1) to approximately atmospheric pressure or above with some of this gas leaving through an exhaust (8) and some through a charge-particle transport device or the desolvation pipe (7).

There is also a chamber (5) which is pumped (20) to $\approx 10^{-4}$ Pa or better. This chamber is shown to house a quadrupole mass spectrometer (18) as well as a corresponding ion detector (19). Between the chambers (1) and (4) two additional evacuated chambers are placed illustrating a good way to provide an efficient differential pumping arrangement. From the ionization chamber (1) the charged particles are introduced through a charged-particle transport device or the desolvation pipe (7) of small diameter into chamber (3) which is pumped (15) to ≈100 Pa. From chamber (3) the charged particles move through a narrow skimmer (14) into chamber (4) which is pumped (17) to $\approx 10^{-2}$ Pa or better before they arrive in chamber (5).

Mainly by the difference of gas pressures in chambers (1) and (3) the generated ions and charged droplets are pushed through a charged-particle transport device or the desolvation pipe into chamber (3) where a plurality of substantially concentric electrodes (13) can focus the ions towards a skimmer (14). In chamber (4) the ions are accelerated and focused towards the small aperture that connects chambers (4) and (5). This focusing lens is shown in FIG. 8 to be an arrangement of rod-like electrodes (16). In chamber (5) ions of a specific mass-to-charge ratio (m/z) are selected by a quadrupole mass spectrometer (18) so that only these ions are recorded in the ion detector (19). Chamber (5) could house also a time-of-flight mass spectrometer, a Fourier-Transform mass spectrometer or any other. The axis of any such mass spectrometer can be arranged to be coaxially to the incoming beam as is shown in FIG. 8, though another angle, for instance 90°, would be feasible as well.

Figure 9:
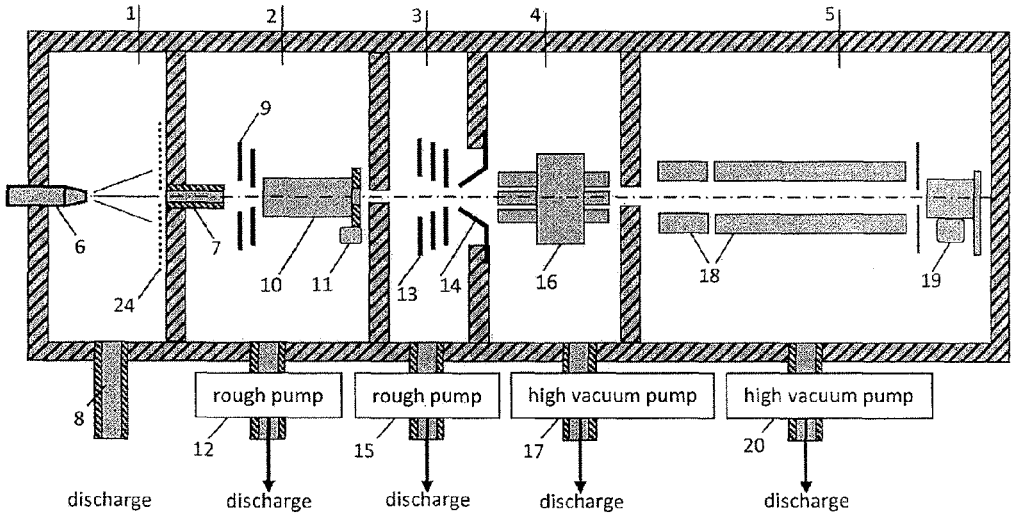
FIG. 9 illustrates the entire configuration of an atmospheric pressure ionization mobility spectrometer from which mobility selected ions are passed through two intermediate chambers to a mass spectrometer.

As illustrated in FIG. 9 the present invention can also be used for an atmospheric pressure ion source coupled to a mobility spectrometer. This mobility spectrometer (10) can work as a stand-alone mobility analyzer or act as a mobility prefilter for ions that are to be analyzed later by a mass spectrometer. The system of FIG. 9 is mainly the system shown in FIG. 8 with the addition of chamber (2) which is arranged between the chambers (1) and (3). This chamber (2) is partially evacuated via (12) to a pressure that in most cases is only slightly lower than that of chamber (1). Chamber (2) houses a mobility spectrometer (10) together with its ion detector (11) as well as a plurality of electrodes (9) that focus the ions to the entrance orifice of the mobility spectrometer. Though the ion detector (11) will record the full mobility spectrum of the ions under consideration, the largest portion of the mobility selected ions can be sent to a mass spectrometer like the one shown in chamber (5) of FIG. 9.

Figure 1:
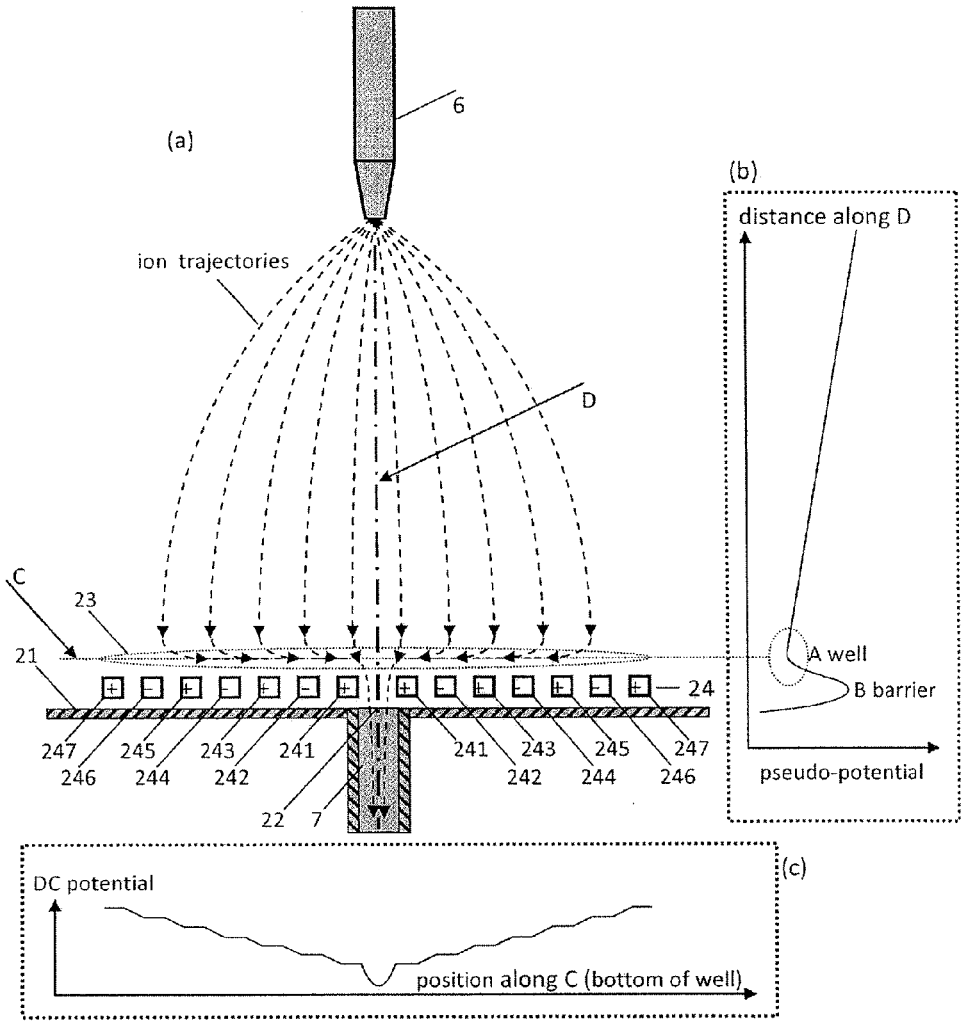
FIG. 1 (*a*) is a schematic view of the plume of charged and uncharged molecules emerging from a nozzle. Shown is also an electrode array according to the present invention that pushes ions towards the axis D of the plume.

The major feature of the present invention is illustrated in FIG. 1(*a*) showing how ions and charged droplets move from the nozzle (6) towards the orifice (22) of a charged-particle transport device or the desolvation pipe (7). This particle motion is governed by the distribution of the pseudo-potential along particle trajectories diagrammed in FIG. 1(*b*) for positive ions with the coordinates along the trajectories being projected onto (D) the axis of symmetry of the particle plume. The distribution of the pseudo-potential caused by the DC potentials of the nozzle (6) and the surface (21) around a charged-particle transport device or the desolvation pipe (7). There are, however, also high-frequency or RF-voltages applied to neighboring electrodes (241-246) of the electrode array (24) with the values of these voltages being indicated by "+" and "−" signs in FIG. 1 for a given instant in time. These RF-voltages cause the charged particles to substantially hover above the electrode array (24) since their motion towards one of the electrodes is stopped before they reach that electrode provided the potential of this electrode has changed its sign fast enough. Right before the ions come to the electrode array (24) they thus experience a repelling force "F" perpendicular to the surface of the electrode array whose effective magnitude is proportional to $$(mV_{RF}^2)/(p^2d^3)$$

according to "Space-charge effects in the catcher gas cell of a RF ion guide", "Review of Scientific Instruments 76 (2005) 103503". Here 'm' is the particle mass, '$V_{RF}$' is the amplitude of the RF-voltage, 'p' is the residual gas pressure and 'd' is the repetitive length in the electrode array, i.e. the distance between two electrodes plus the width of one of them as is shown in FIGS. 4, 5, 6, 7, 12, 13 and 14 for two repetitive lengths "$d_1$" and "$d_2$" and in FIGS. 15, 16 and 17 for one repetition length "d". This force "F" causes an effective barrier (B) right before the electrode array (24) and consequently a pseudo-potential well (A) where the charged particles stop their motion parallel to the plume axis (D). Thus they accumulate around the center line (C) of this well (A). The approximate area (23) of the cloud of charged particles in this well is indicated in FIG. 1(*a*). Applying additionally to the RF-potentials also DC-potentials to neighboring electrodes within the electrode array (24) small DC-fields can be formed within the well area (23) as is indicated in FIG. 1(*c*). These additional DC-fields drive the charged particles towards the axis of symmetry (C) and thus towards the orifice (22) of a charged-particle transport device or the desolvation pipe (7). Thus, many of the charged particles which would normally impinge on the wall (21) around the orifice (22) can now be analyzed.

Though the two potential diagrams in FIG. 1 both assume positively charged particles, it is worth noting, that the repelling force "F" is of equal magnitude for negative ones. Thus the same trajectories will be observed for positive as well as for negative charged particles as long as the signs of the DC-potentials are all reversed.

Figure 2:
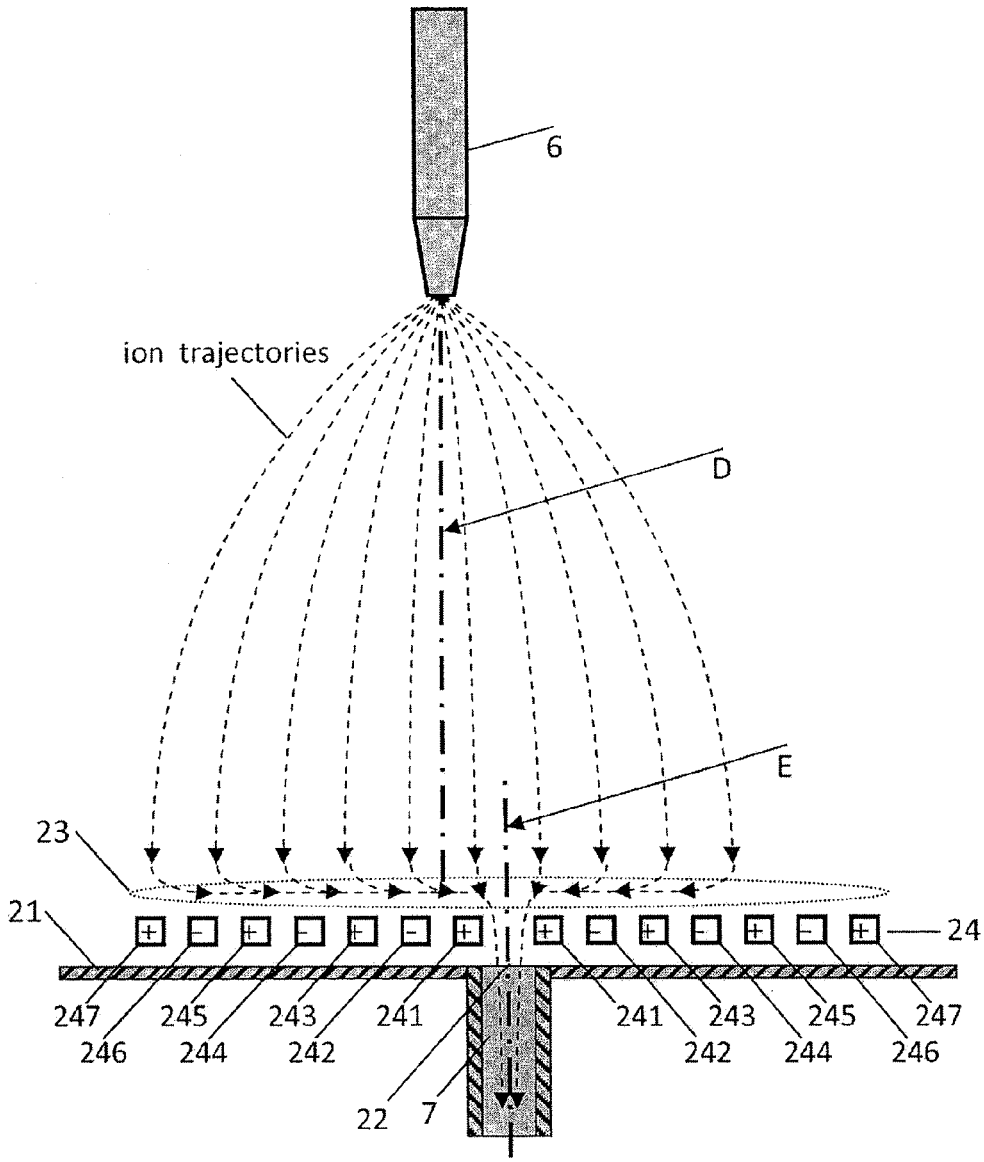
FIG. 2 is a variation of FIG. 1 showing that in this embodiment said axis D of said plume is laterally displaced relative to the axis E of the so-called desolvation pipe (6) or some other charged particle transport device.
Figure 3:
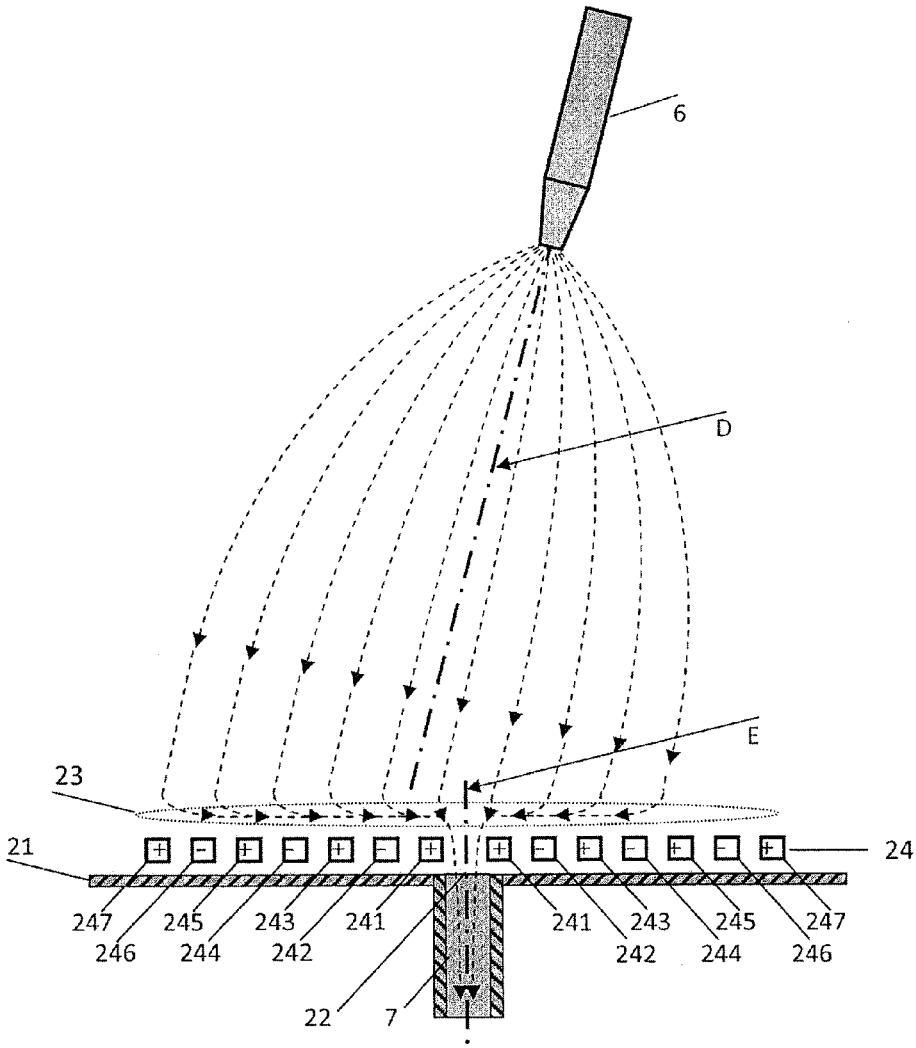
FIG. 3 is a variation of FIG. 2 showing that in this embodiment said axis D of said plume is inclined relative to the axis E of the so-called desolvation pipe (6) or some other charged particle transport device.

The embodiment of FIG. 1 can advantageously be changed to that of FIG. 2 or FIG. 3. In both cases the axis D of the particle plume does not meet the electrode array in its middle. Thus larger droplets that tend to move substantially along the axis D will not enter the charged-particle transport device or the desolvation pipe (7) directly while it can still be reached by charged particles. In the embodiment of FIG. 2 this is achieved by laterally displacing the axis D relative to the axis E of the charged-particle transport device or the desolvation pipe and in the embodiment of FIG. 3 by inclining the axis D of the particle plume.

Detailed embodiments of the electrode array (24) are shown in FIGS. 4, 5, 6 and 7. In all cases darker and lighter electrodes indicate that the RF-voltage causes one group to have opposite voltages as compared to the other at any given moment in time.

Figure 4:
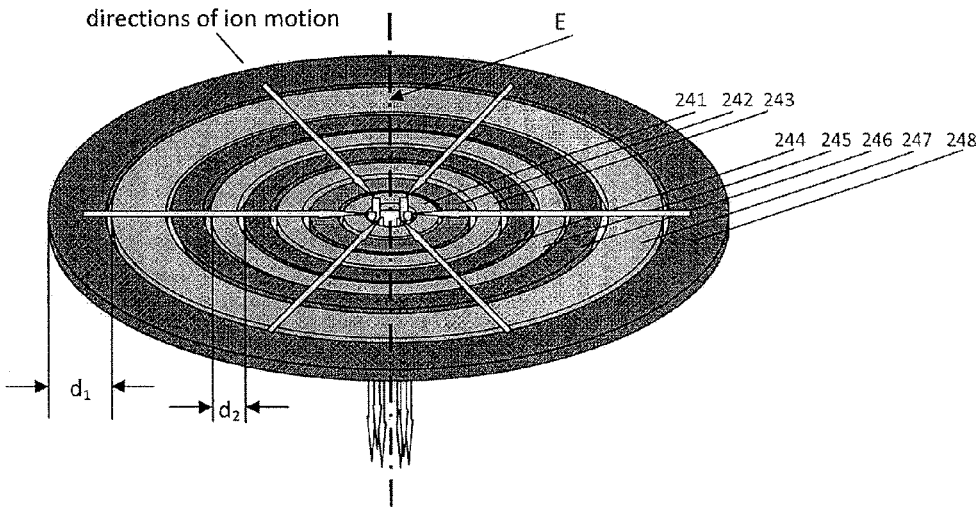
FIG. 4 shows a possible embodiment of said electrode array featuring concentric circular electrodes placed on one plane. Electrodes at different phases of the RF-potential are shown in lighter and darker gray shades.

In FIG. 4 an electrode array is shown that consists of substantially circular electrodes (241-248) arranged substantially concentric and located on one plane. Such an electrode array can be formed as metal strips on a printed circuit board though explicit electrodes of rectangular, circular or elliptical cross section are possible as well. The axis E of this electrode array can be assumed to substantially pass through the center of the orifice (22) of the inlet of a charged-particle transport device or the desolvation pipe (7) shown in FIG. 1. The surface (21) around this charged-particle transport device or the desolvation pipe is usually but not necessarily parallel to the surface of the electrode array. In such an arrangement the ions would hover above the electrode array and be pushed radially towards the axis of the electrode array so that they can be sucked into the orifice (22) of the charged-particle transport device or the desolvation pipe (7) by additional DC fields as well as by forces due to gas flow.

Figure 5:
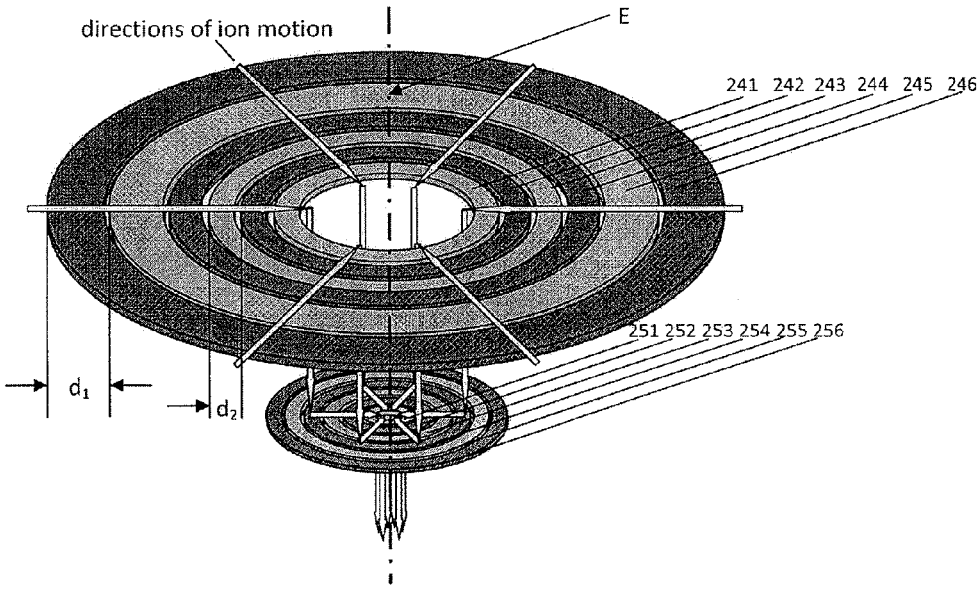
FIG. 5 shows a possible embodiment of said electrode array featuring concentric circular electrodes placed on two substantially parallel planes of which said electrode array on the upper plane acts as a precondenser. Also in this case electrodes at different phases of the RF-potential are shown in lighter and darker gray shades.

In FIG. 5 a combination of two electrode arrays is shown both of which consist of substantially circular electrodes (241-246) and (251-256) that are arranged substantially concentric with respect to the orifice (22) of a charged-particle transport device or the desolvation pipe (7). The first of these electrode arrays pre-condenses the ions towards some larger orifice. Having passed through this orifice the charged particles are pushed by a small potential difference towards the second electrode array. This array then condenses these ions towards a usually smaller orifice.

Figure 6:
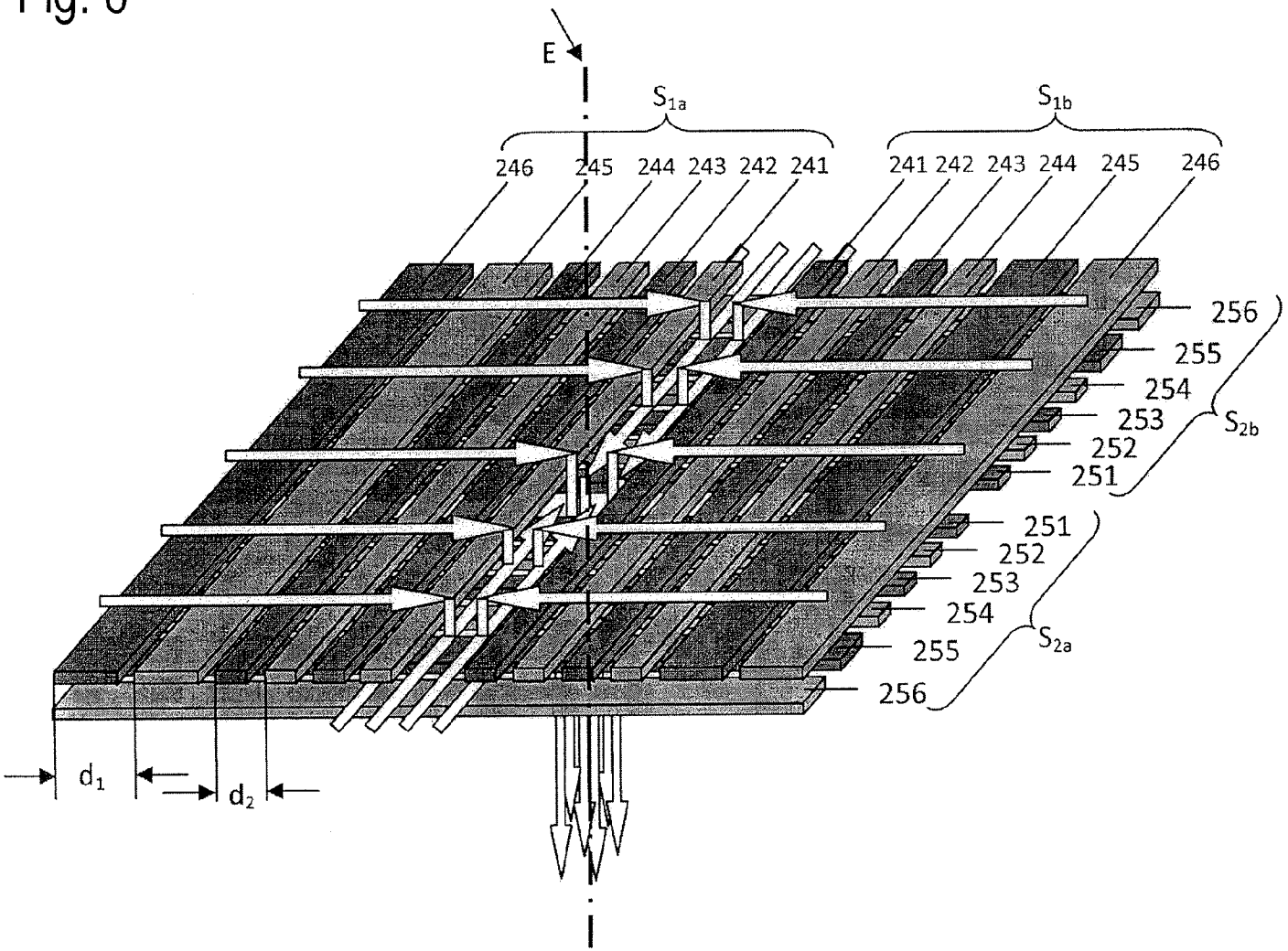
FIG. 6 shows a possible embodiment of said electrode array featuring parallel electrodes placed on two substantially parallel planes in which the electrode arrays are arranged under some angle so that the ions or other charged particles are condensed in substantially perpendicular directions. Also in this case electrodes at different phases of the RF-potential are shown in lighter and darker gray shades.

In FIG. 6 another combination of two electrode arrays is shown both of which consist of substantially parallel electrodes (241-246) as well as (251-256). The first one of these electrode arrays pushes the ions perpendicularly to the electrodes towards a slit-like orifice but does not exert forces in the direction parallel to the electrodes. Having passed through this orifice the charged particles are pushed by a small potential difference to the second electrode array. This second electrode array pushes the particles perpendicularly to its electrodes. Arranging the electrodes in the second array substantially orthogonally relative to the electrodes in the first array the charged particles are condensed to a very small area at the end. In FIG. 6 the directions in which the charged particles are pushed by these two electrode arrangements is chosen to be ≈90°, though a different angle is possible also Naturally one could also combine the actions of arrays of substantially parallel electrodes and arrays of substantially concentric and substantially circular electrodes.

Figure 7:
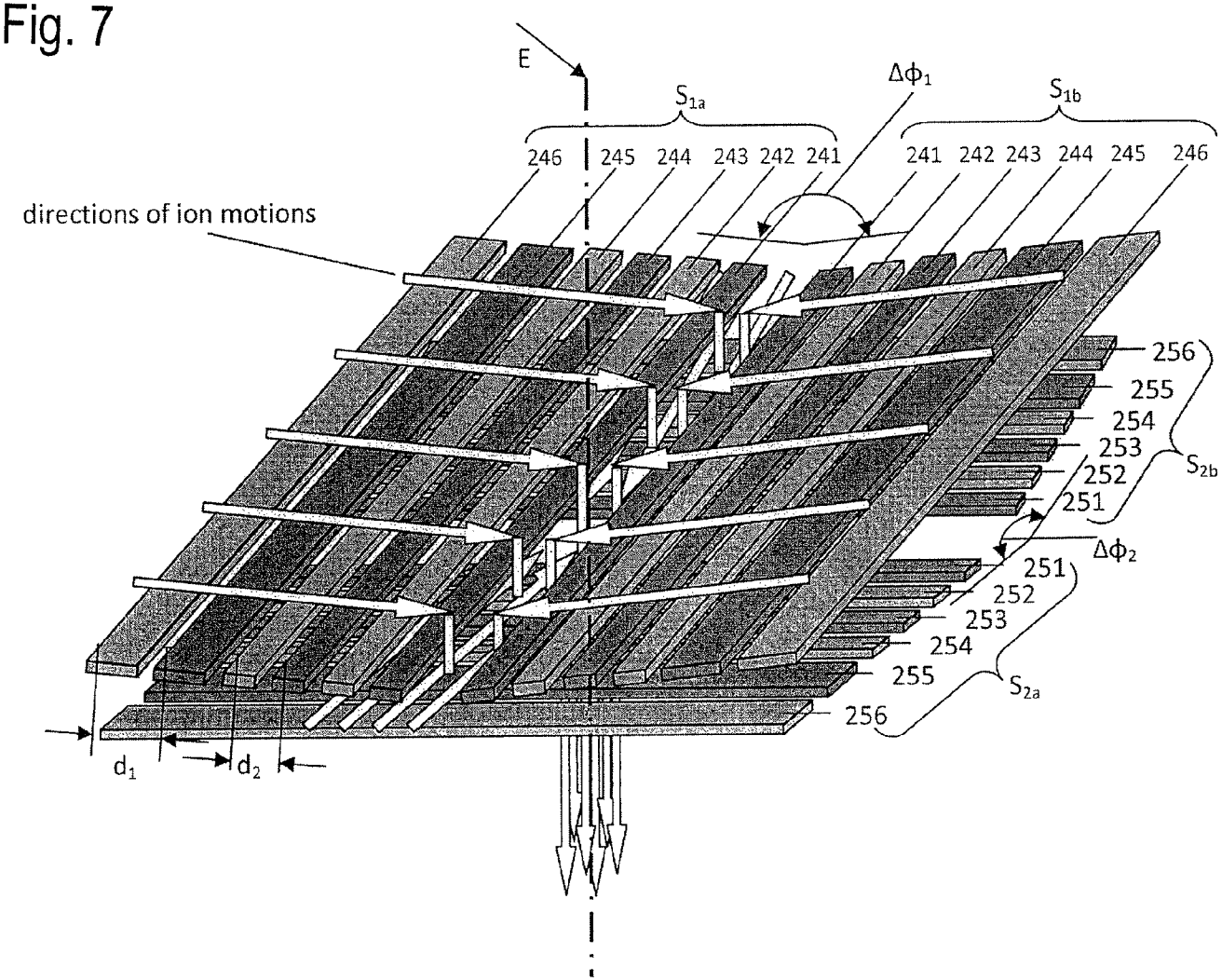
FIG. 7 is a variation of FIG. 6 showing that in this embodiment said electrode arrays are placed on slightly inclined planes. Also in this case electrodes at different phases of the RF-potential are shown in lighter and darker gray shades.

In FIG. 7 a double electrode array is shown both of which consist of substantially parallel electrodes (241-246) as well as (251-256) as those of FIG. 6. The electrodes are arranged, however, on planes that are not parallel but rather inclined relative to each other. Since said effective force $F \propto (mV_{RF}^2)/(p^2d^3)$ acts perpendicularly to the surface of an electrode array it must balance that component of the ion velocity that is parallel to "F". If the normal to the surface of the electrode array forms an angle with the velocity vector of the incoming charged particles, thus the component of their velocity parallel to "F" thus is a factor of $\cos(\alpha)$ smaller than their full velocity.

Figure 10:
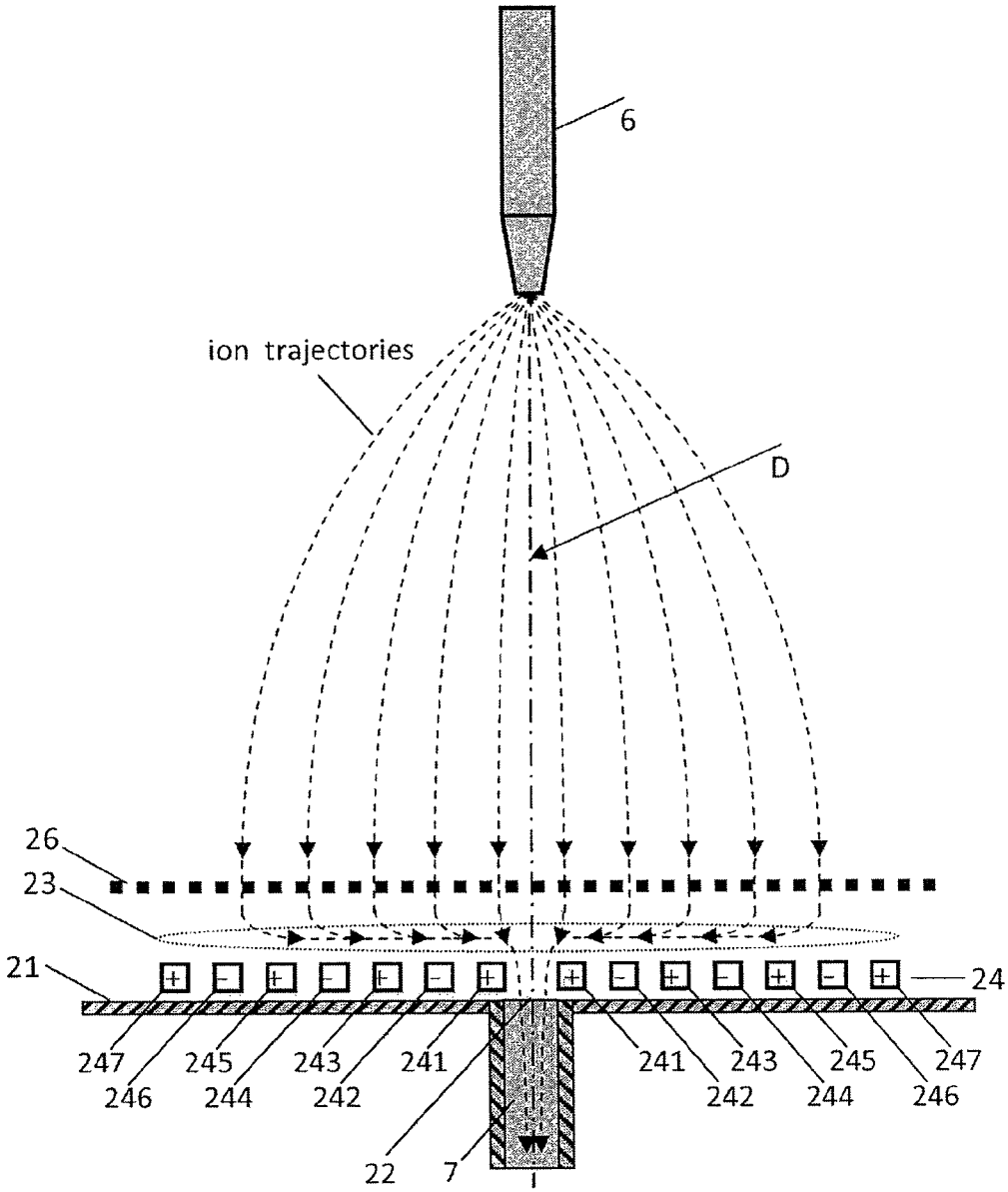
FIG. 10 is a variation of FIG. 1 showing that in this embodiment the ions or other charged particles must pass at least through one grid before they can reach said electrode array.
Figure 11:
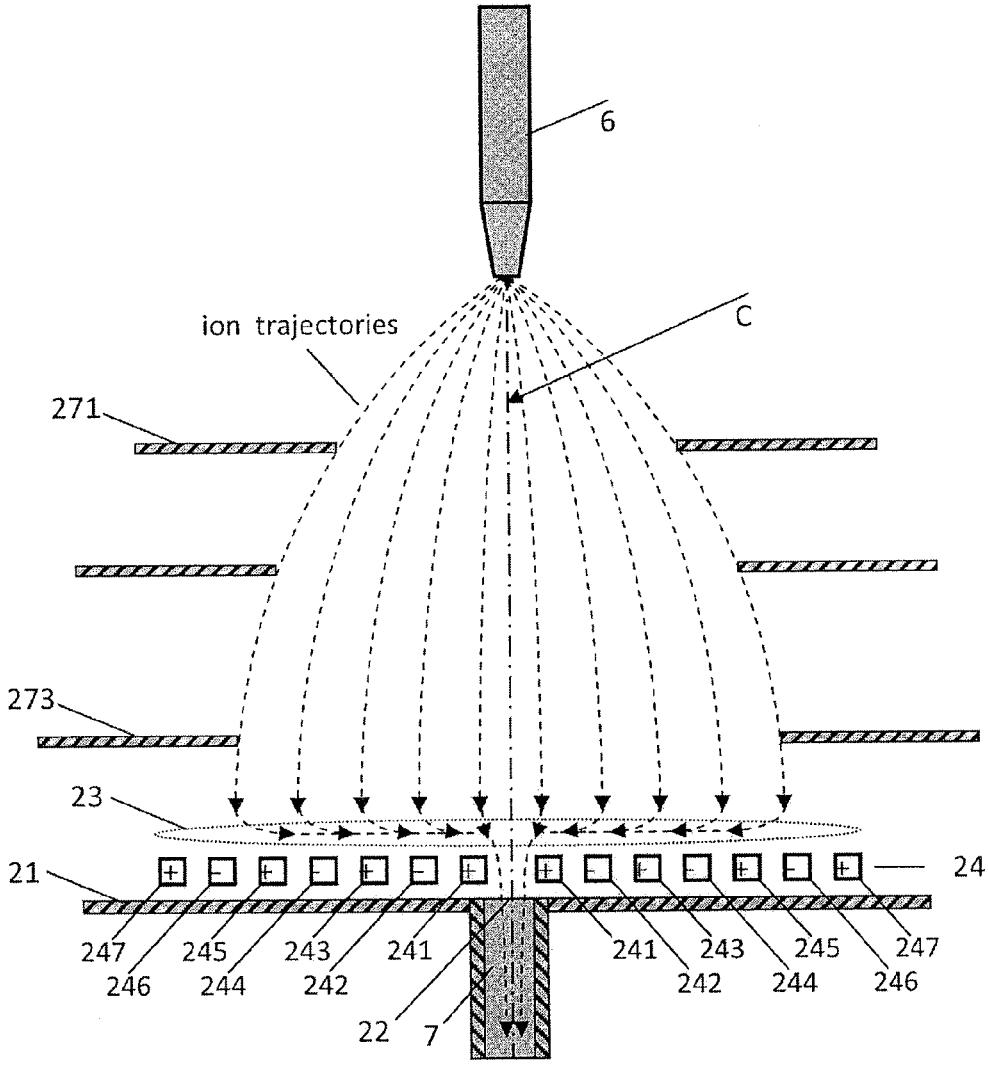
FIG. 11 is a variation of FIG. 1 showing that in this embodiment the ions or other charged particles must pass through at least one diaphragm before they can reach said electrode array.

In FIG. 10 and FIG. 11 embodiments of the present invention are shown that can reduce the velocity of the charged particles when they approach the electrode array. In FIG. 10 these particles can reach the electrode array (24) only after they have passed through at least one grid (26) which can be at a potential that differs not too much from the DC-potential of the electrode array. In FIG. 11 the charged particles can reach the electrode array only after they have passed through diaphragms (271), (272), (273) which can be at such DC-potentials that their kinetic energy is reduced to a level that they can be trapped by the RF-potentials of the electrode array (24). One or several such diaphragms can also influence and partially redirect the gas stream arising from the neutral gas atoms moving towards the electrode array. This can be especially advantageous if one or several exhausts (8) are arranged such that part of the gas stream is redirected to be substantially parallel to the surface of the electrode array and away from the axis of a charged-particle transport device or the desolvation pipe (7).

By reducing the repetition length "d" of the electrode array in question, i.e. by reducing the widths and the separation of the individual electrodes, the force. $F \propto (mV_{RF}^2)/(p^2d^3)$ itself can be increased noticeably. Reducing this length "d", however, eventually causes problems in fabrication. Using the technique of printed circuit boards, allows to produce rather small structures, but it is not trivial to attach wire leads to them.

Figure 12:
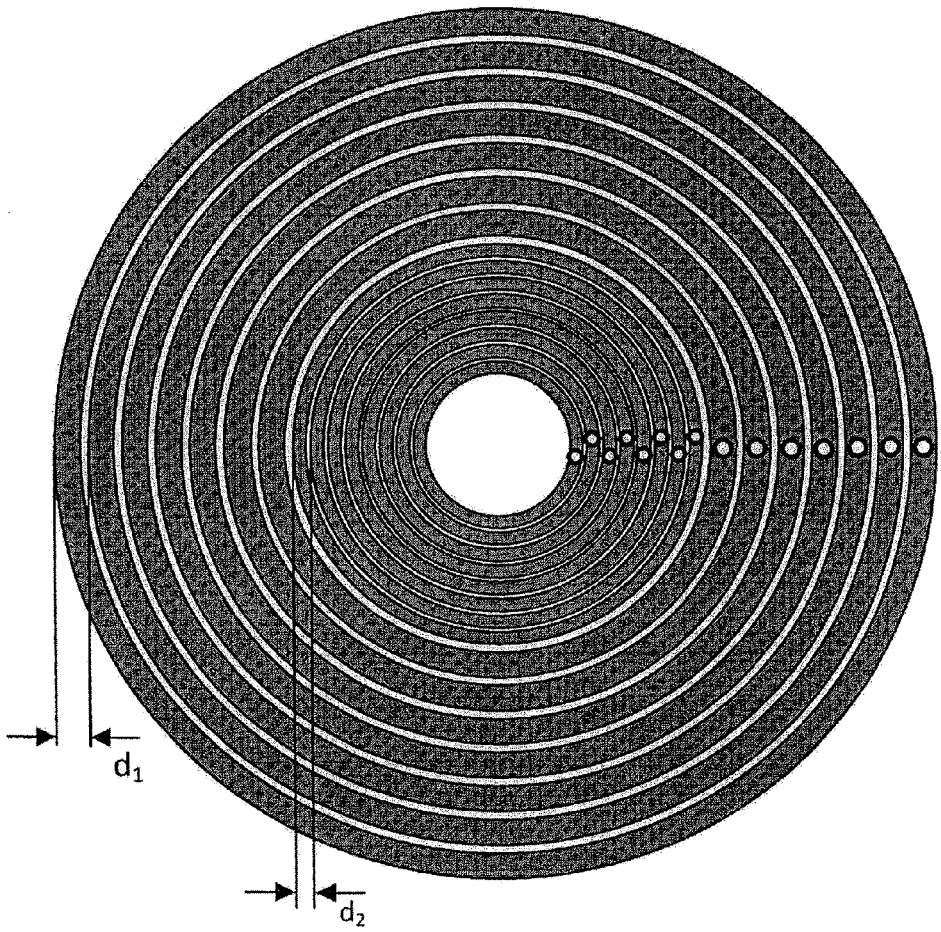
FIG. 12 illustrates an embodiment of arrays of circular electrodes of FIG. 4 or 5 in the form of printed circuit boards in which case the potentials are fed to the different electrodes through vias whose diameters must be smaller than "$d_1$" or "$d_2$", respectively, And thus demands minimal repetition lengths.
Figure 13:
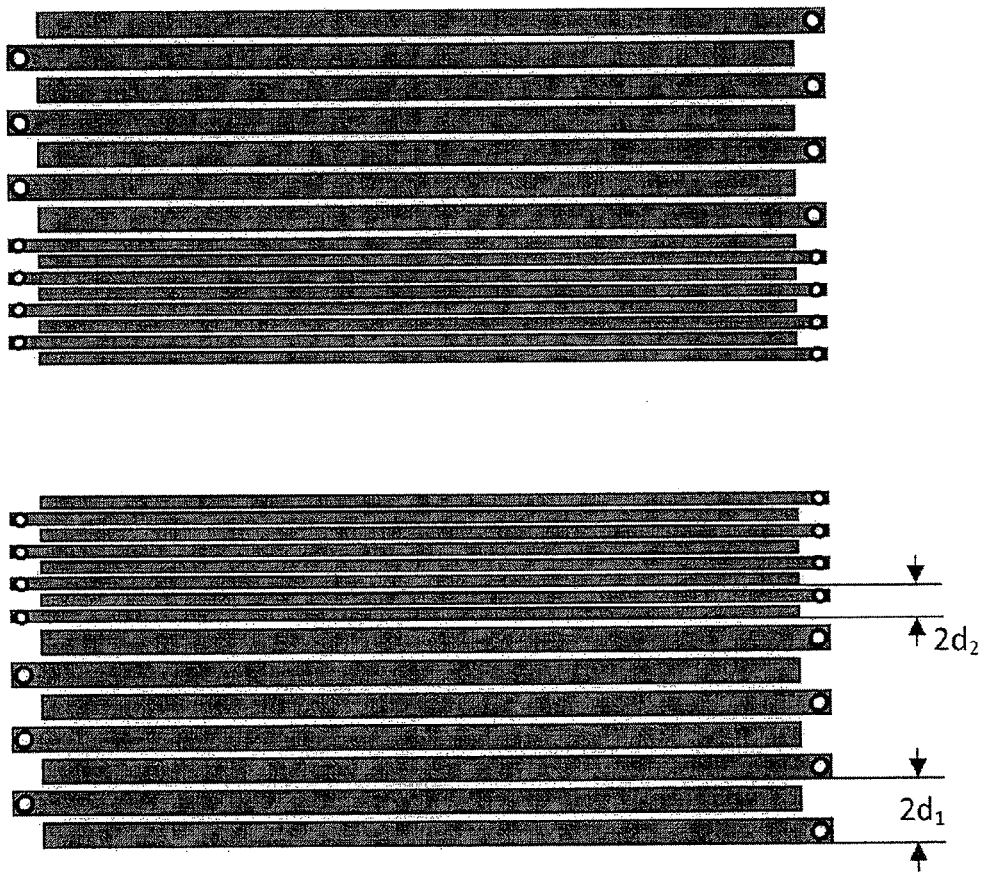
FIG. 13 illustrates an embodiment of arrays of parallel electrodes of FIG. 6 or 7 in the form of printed circuit boards in which case the potentials can be fed to the different electrodes through vias whose diameters must be smaller than "$2d_1$" or "$2d_2$", respectively, i.e. twice the repetition lengths. In this embodiment, however, direct connections to the potential supplies would be feasible as well within the plane of the electrode array.

To arrays of substantially concentric and substantially circular electrodes the appropriate potentials can be supplied only in a direction perpendicular to the electrode array. This can for instance be done by explicit wires or as is illustrated in FIG. 12 by vias. One should note, however, that the diameter of the vias must be smaller than "$d_1$" and "$d_2$", the two repetition lengths shown in FIG. 12.

To arrays of substantially parallel electrodes the appropriate potentials can be supplied in the plane of the electrode array which can be done by rather narrow leads. Even if for some reason vias must be used, their diameter must only be smaller than "$2d_1$" and "$2d_2$", the double repetition lengths shown in FIG. 13.

Figure 14:
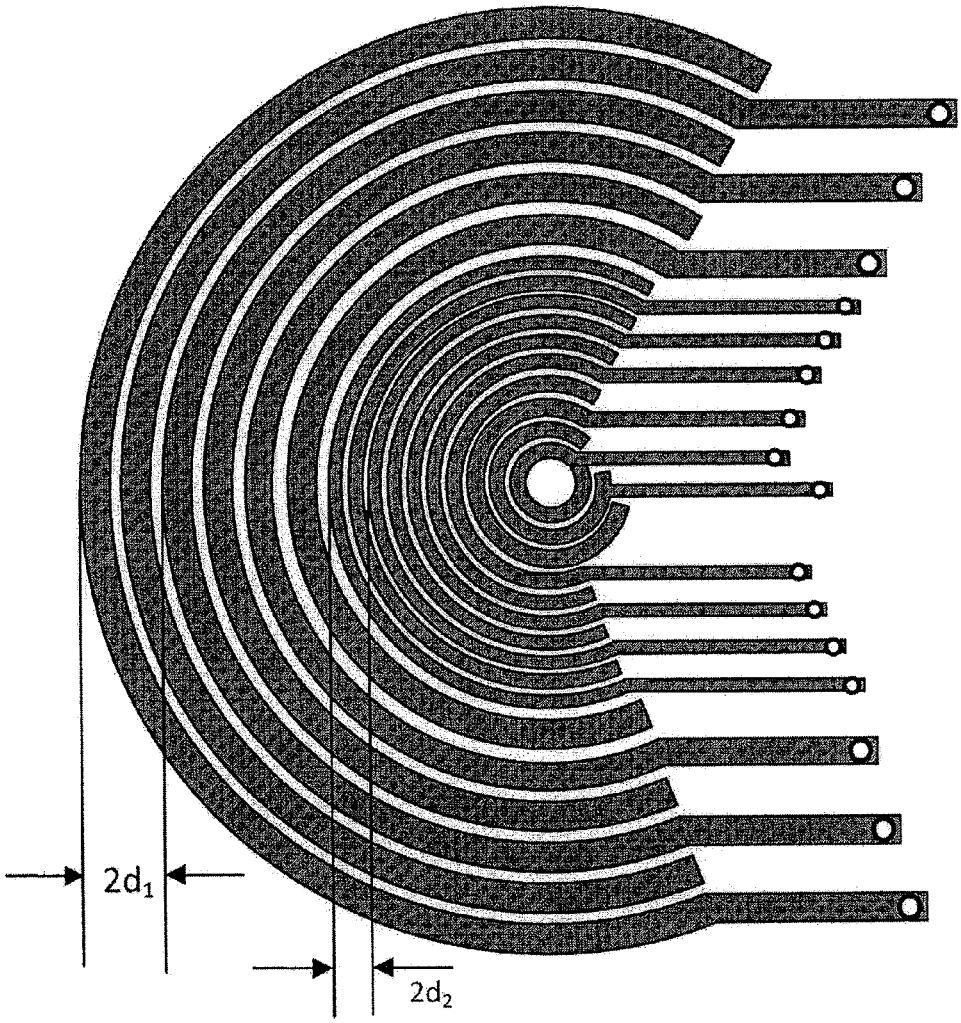
FIG. 14 illustrates an embodiment of arrays of sections of circular electrodes built in the form of printed circuit boards. In this embodiment the potentials can be fed to the different electrodes through vias whose diameters must be smaller than "$2d_1$" or "$2d_2$", respectively, i.e. twice the repetition lengths. In this arrangement, however, direct connections to the potential supplies would be feasible as well.

One way to supply to substantially circular and substantially concentric electrodes the appropriate potentials in the plane of the electrode array is shown in FIG. 14 which requires, however, that the electrodes do not form full 360° rings but rather only sections of such rings. In the shown FIG. 14 these sections cover slightly more than 180°. Even if for some reason vias must be used, their diameter must only be smaller than "$2d_1$" and "$2d_2$", the double repetition lengths shown in FIG. 14. In this case it is advisable to direct the axis of the ion plume not to the orifice itself but to a displaced position such that all ions reach a position of the array surface at which electrodes are placed.

Figure 15:
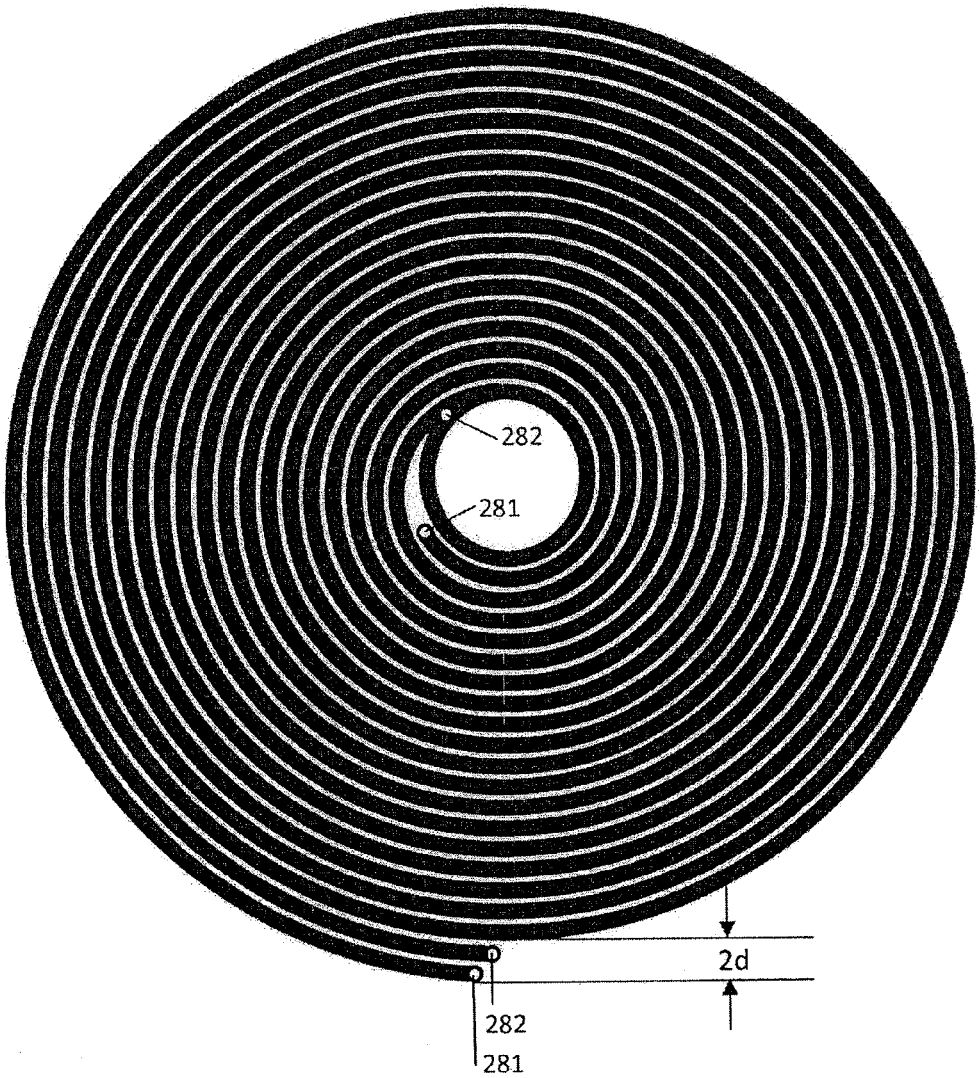
FIG. 15 illustrates an embodiment of substantially concentric electrodes approaching the shape of a spiral. This electrode array requires only two connections for the RF-potential. In order to establish a radial DC-field, however, the two electrodes must be built from resistive material and different DC-potentials must be applied to the ends of each electrode.

There is also the possibility to shape the substantially circular and substantially concentric electrode array as a spiral-like structure as is shown in FIG. 15 for two such "spirals". To this structure the RF-potentials must be applied only to one end of each "spiral". DC-potentials, however, must be applied to both ends of each "spiral" so that currents can flow through the "spirals" and establish potential drops along their lengths. In this embodiment of the present invention the "spirals" are advantageously built from high resistivity material so that the power losses stay within limits.

Figure 16:
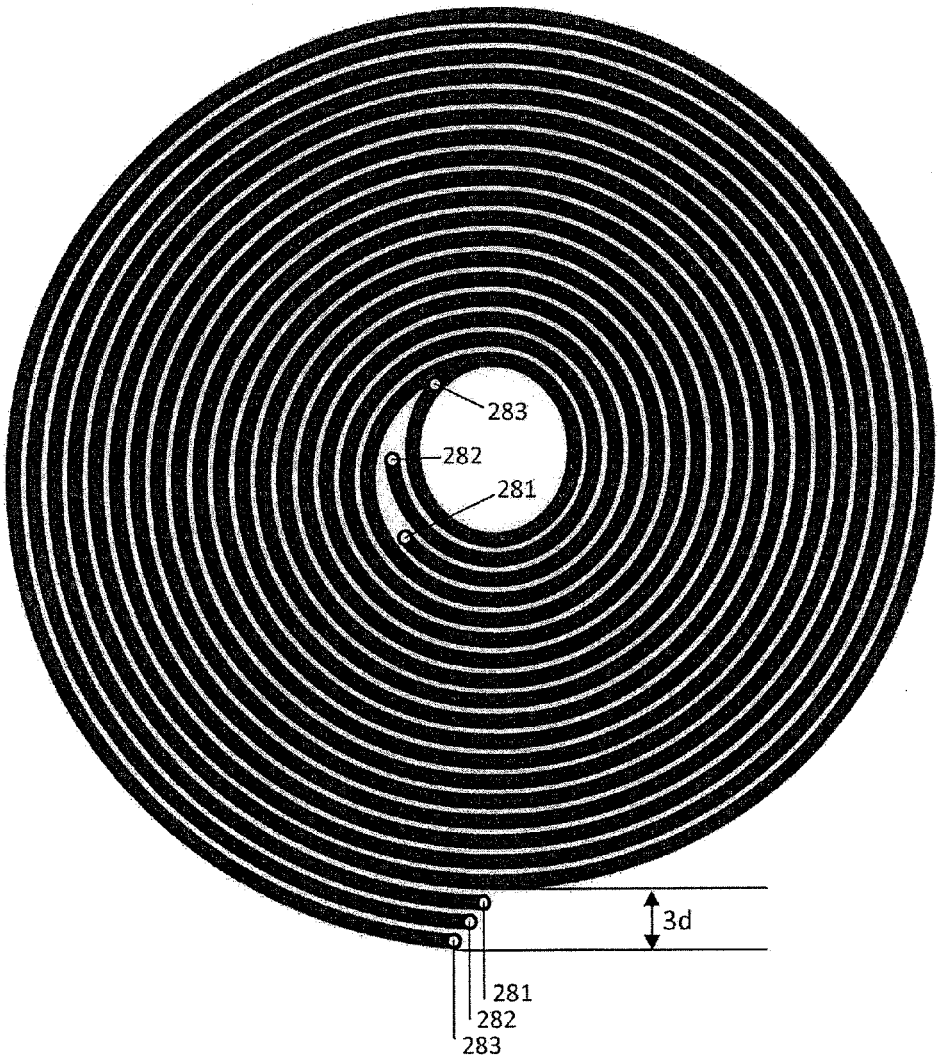
FIG. 16 illustrates an embodiment of substantially concentric electrodes that is very similar to the spiral-like electrodes of FIG. 15. In this embodiment three electrodes are foreseen and it is anticipated that to them RF-voltages are applied whose phases differ by 120°. In this case a travelling wave can be formed that carries the ions or other charged particles towards the center without the need of separate DC-voltages.

There is also the possibility to use not 2 intertwined "spiral-like" structures as shown in FIG. 15 but rather 3, 4, 5, . . . . Depicted in FIG. 16 is a "3-fold-spiral". Such systems can be used in the same fashion as the "2-fold-spiral" structure of FIG. 15 by applying DC-potentials to both ends of each spiral and RF-potentials to one. However, these structures can also be used without DC-fields provided the frequency and the phases of the applied RF-potentials are chosen properly. For an "n-fold-spiral" the potential differences here should be 360°/n, so that the phase difference for the structure shown in FIG. 16 should be chosen to be 120°. For cases in which n>3, however, these voltages can also be chosen such that a potential depression moves radially inward towards the center of the "spirals".

It should be noted here that the precision of fields close to the center of "spiral-like" structures as shown in FIG. 15 and FIG. 16 are slightly compromised as compared to a structure built from ring electrodes. However, these compromises can well be tolerated since as said above—close to the orifice there are additional rather strong forces due to the ion acceleration into the orifice and due to the gas stream into this orifice as one may see from FIG. 19.

Figure 17:
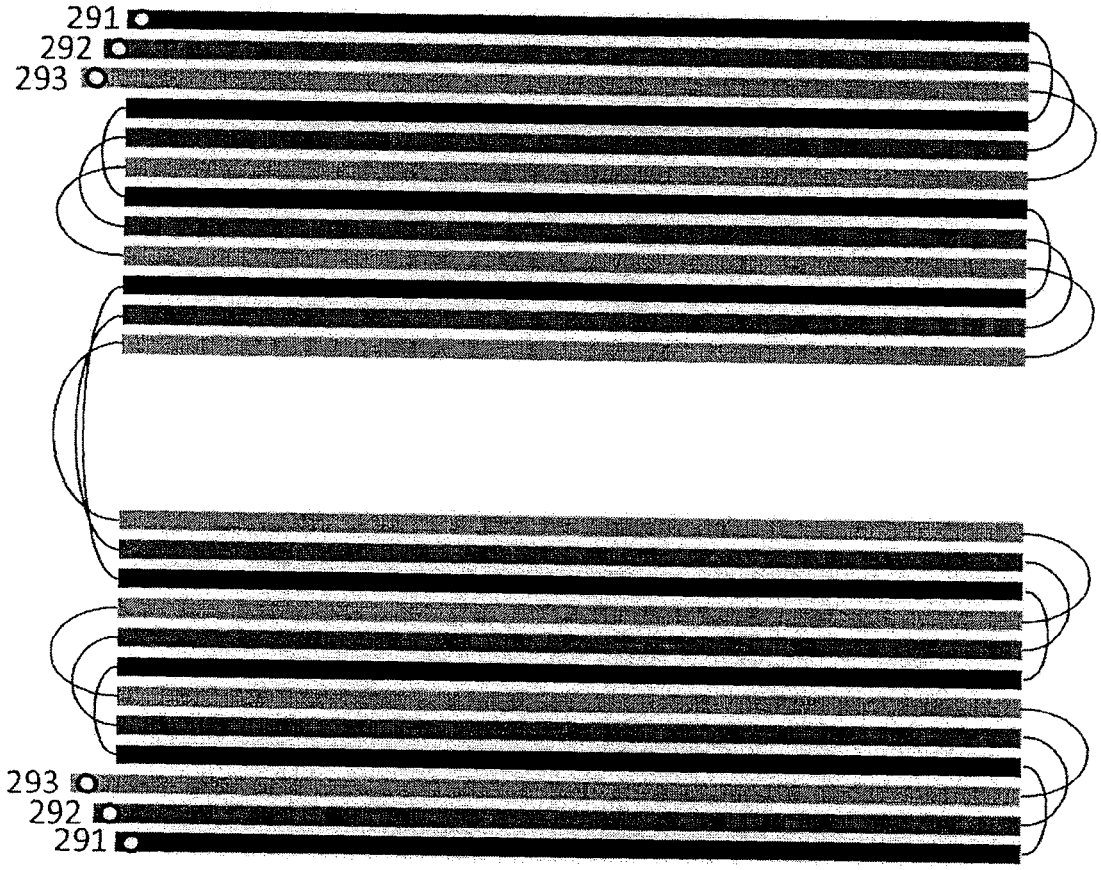
FIG. 17 illustrates an embodiment of substantially parallel electrodes that is connected such that they form a "meander-like" structure. In this embodiment three electrodes are foreseen and it is anticipated that to them RF-voltages are applied whose phases differ by 120°. In this case also a travelling wave can be formed that carries the ions or other charged particles towards the center without the need of separate DC-voltages.

The technique of a traveling wave can also be applied to an electrode array that consists of elongated substantially parallel electrodes. In this case the electrodes must be connected thus that the shape of the electrodes become meander-like. In FIG. 17 a "3-fold meander" is shown though any "n-fold meanders" can be built in the same fashion.

Figure 18:
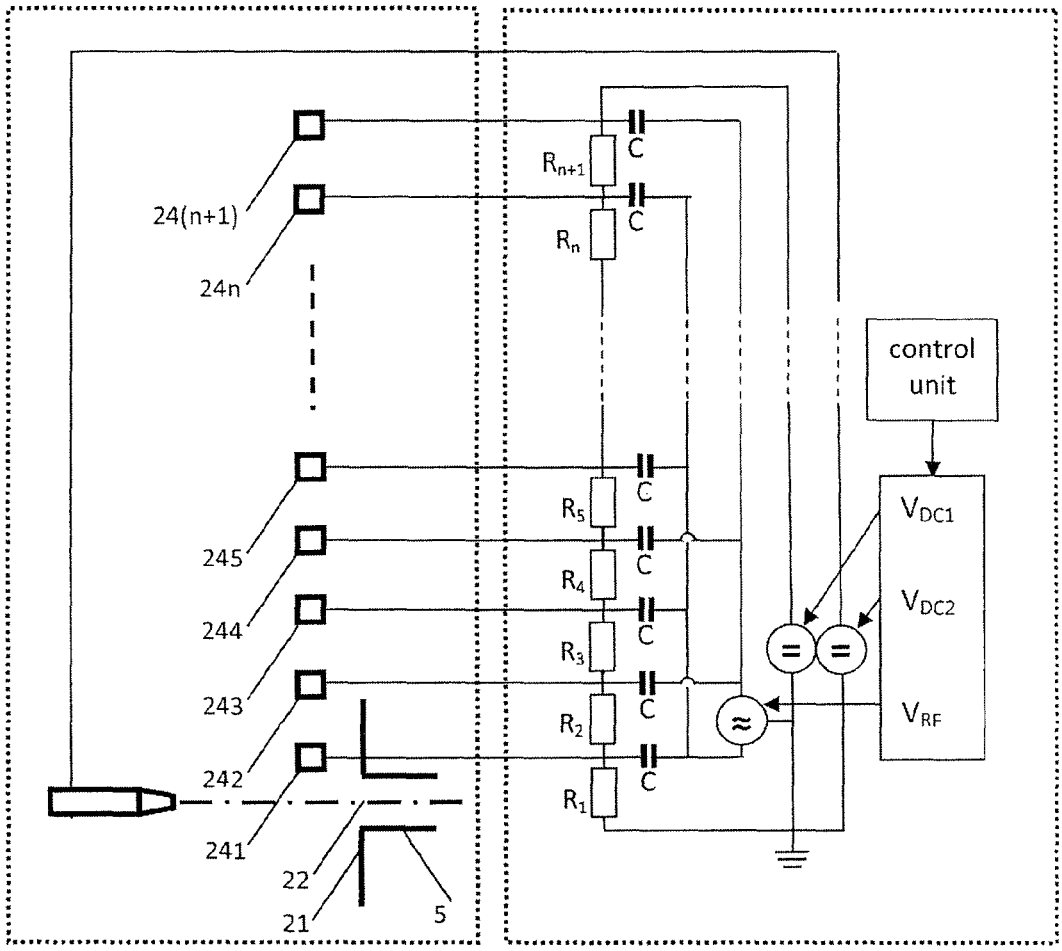
FIG. 18 illustrates an electronic circuit that can produce RF- and DC-voltages as required for the circuits shown in FIGS. 1, 2, 3, 4, 5, 6, 7, 10, 11, 12, 13 and 14.
Figure 19:
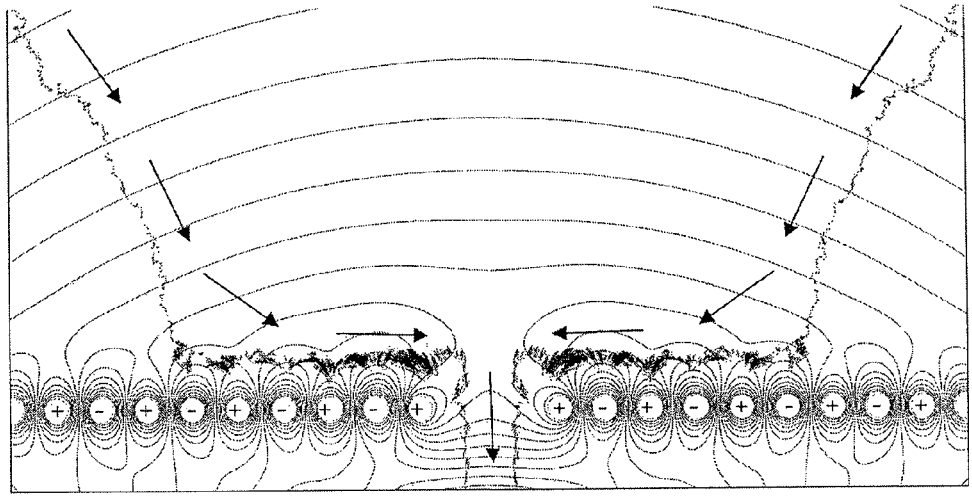
FIG. 19 illustrates the motion of ions or other charged particles as obtained from numerical trajectory calculations in an embodiment of the present invention illustrated in FIG. 1.

The RF- and DC-voltages that must be applied to the different electrodes of an array as shown in FIGS. 1, 2, 3, 4, 5, 6, 7, 10, 11, 12, 13, 14 and 15 can be produced in electric circuits like the one illustrated in FIG. 18. Such systems must feature at least one high frequency (RF) and at least one DC-power source from which the different DC-voltages for the electrodes of the array can be derived. These DC-voltages can be obtained from a resistive voltage divider as is shown in FIG. 18 but they can also be obtained from a number of individual digital-analog-converters (DACs) that are driven digitally by some computers.

The invention claimed is:

1. A charged-particle condensing device that operates in a gas of approximately one atmosphere in which charged particles have been formed and are accelerated towards a surface that contains at least one orifice through which they can move to an evacuated mass spectrometer or a gas-filled mobility spectrometer characterized by the fact that the charged-particle condensing device comprises an array of many closely spaced electrodes or conductive surface strips placed on said surface or positioned a short distance above said surface such that an opening is left for the charged particles to move to said at least one orifice with RF-voltages being applied between neighboring said electrodes or conductive strips causing RF-fields that keep the charged particles hovering above said electrodes or conductive strips so that they can be pushed towards said orifice by fields caused by additional DC-potentials being applied to neighboring said electrodes or conductive strips.

2. A charged-particle condensing device according to claim 1 characterized by the fact that the electrodes or conductive strips are substantially concentric circles placed on a substantially flat surface with the DC-electric potentials pushing the charged particles radially towards the center of the substantially concentric circles which is aligned to a substantially circular orifice through which they can pass.

3. A charged-particle condensing device according to claim 2 characterized by the fact that the electrodes or conductive strips are formed in the technique of printed circuit boards and the RF- and DC-potentials are applied to the electrodes through vias whose diameter must stay smaller than the repetition length, i.e. the sum of the width of one electrode or conductive strip plus the separation from the next electrode.

4. A charged-particle condensing device according to claim 2 characterized by the fact that the electrodes or conductive strips are formed in the technique of printed circuit boards with said electrodes or conductive strips not being full rings but only ring sections so that the RF- and DC-potentials can be applied directly through leads from the electric supply circuit to said electrodes or conductive strips in their plane or planes.

5. A charged-particle condensing device according to claim 2 characterized by the fact that the electrodes or conductive strips are formed in the technique of printed circuit boards with the electrodes or conductive strips not being full rings but only ring sections in which case the RF- and DC-potentials can be applied through vias whose diameter must only stay smaller than twice the repetition length, i.e. twice the sum of the width of one electrode or conductive strip plus its separation from the next electrode or the next conductive strip.

6. A charged-particle condensing device according to claim 2 characterized by the fact that the electrodes or conductive strips are formed in the technique of printed circuit boards with the ring structure of substantially circular and substantially concentric electrodes or conductive strips being approximated by two intertwined spirals with the RF-voltages being applied between the spirals and the DC-potentials along each spiral being formed by applying to both ends of each spiral appropriate DC-potentials and building the electrodes or conductive strips from high-resistivity material.

7. A charged-particle condensing device according to claim 2 characterized by the fact that the electrodes or conductive strips are formed in the technique of printed circuit boards with the ring structure of substantially circular and substantially concentric electrodes or conductive strips being approximated by two intertwined spirals formed on the front-side as well as on the back-side of a thin printed circuit board with the spirals on the back-side of the printed circuit board comprising well conductive material and the spirals on the front-side of the printed circuit board comprising high-resistivity material in which case the DC-potentials along the spirals are formed by applying appropriate DC-potentials to both ends of each of the front-side spirals while the RF-voltages are applied to the two back-side spirals in which case the RF-potentials are capacitively coupled to the spirals on the front side.

8. A charged-particle condensing device according to claim 2 characterized by the fact that the electrodes or conductive strips are formed in the technique of printed circuit boards with the ring structure of substantially circular and substantially concentric electrodes or conductive strips being approximated by "N=3, 4, . . . " intertwined spirals with the RF-voltages being applied to neighboring spirals at phase differences of substantially 360°/N and the DC-potentials along each spiral being formed by applying to both ends of each spiral appropriate DC-potentials and building the electrodes or conductive strips from high-resistivity material.

9. A charged-particle condensing device according to claim 8 characterized by the fact that the DC-potentials are zero and the RF-frequency is adjusted such that the charged particles experience a field that transports them towards the center of the substantially circular and substantially concentric electrodes or conductive strips.

10. A charged-particle condensing device according to claim 9 characterized by the fact that the RF-voltage are chosen such that a potential depression is formed that moves from the spiral-1 to spiral-2 to spiral-3 to . . . to spiral-N and pulls charged particles substantially in radial direction towards the center of the ring electrodes.

11. A charged-particle condensing device according to claim 2 characterized by the fact that the electrodes or conductive strips are formed in the technique of printed circuit boards with the ring structure of substantially circular and substantially concentric electrodes or conductive strips being approximated by "N=3, 4, . . . " intertwined spirals which are formed on the front-side as well as on the back-side of a thin printed circuit board, with the spirals on the back-side of the printed circuit board comprising well conductive material and the spirals on the front-side of the printed circuit board comprising high resistivity material in which case the DC-potentials along each front-end spiral are formed by applying appropriate DC-potentials to both ends of each of the front-side spirals while the RF-voltages are applied to neighboring back-side spirals with phase differences of substantially 360°/N when going from one spiral to the next, in which case the RF-potentials are capacitively coupled to the high-resistivity spirals on the front side.

12. A charged-particle condensing device according to claim 2 characterized by the fact that the electrodes or conductive strips on different surfaces but also within one of these surfaces have different widths and/or separations.

13. A charged-particle condensing device according to claim 2 characterized by the fact that the axis of the initial charged-particle plume is directed such as to not meet the center of the substantially circular and substantially concentric electrodes or conductive strips with this axis shift being achieved by laterally shifting the initial cloud of charged particles or by tilting its main direction of motion.

14. A charged-particle condensing device according to claim 2 characterized by the fact that the axis of the initial ion and charged-particle plume is directed such as to not meet the line of intersection of the surfaces that carry electrodes or conductive surface strips that are substantially parallel to this line of intersection with this axis shift being achieved by laterally shifting the initial cloud of charged particles or by tilting its main direction of motion.

15. A charged-particle condensing device according to claim 2 characterized by the fact that there are two surfaces on which electrodes or conductive strips are placed which are both substantially concentric circles in which case the DC-electric potentials on the different rings of the first surface push the charged particles radially towards the center of the substantially concentric circular electrodes or conductive strips where an orifice is located through which they can be accelerated towards the second surface where the DC-potentials on the different rings on the second surface push them towards the center of the respective substantially concentric electrodes or conductive strips towards another orifice which in most cases is smaller than the first one.

16. A charged-particle condensing device according to claim 1 characterized by the fact that said electrodes or conductive strips are substantially straight and substantially parallel and are placed on two substantially flat surfaces $S_{1a}$ and $S_{1b}$ that are inclined relative to each other by some angle $\Delta\Phi_1$ such that their line of intersection is substantially parallel to the electrodes or conductive strips in which case the DC-electric potentials of the different electrodes and conductive strips push the charged particles substantially perpendicular to the extension of these electrodes or conductive strips towards the line of intersection of said two surfaces $S_{1a}$ and $S_{1b}$ where they form a narrow but elongated cloud of charged particles that can be accelerated through an elongated orifice placed at this line of intersection.

17. A charged-particle condensing device according to claim 16 characterized by the fact that to said set of substantially flat surfaces $S_{1a}$ and $S_{1b}$ inclined relative to each other by $\Delta\Phi_1$ a separate second set of substantially flat surfaces $S_{2a}$ and $S_{2b}$ inclined relative to each other by $\Delta\Phi_2$ is added in which case the charged particles that had been pushed by the DC-electric potentials on the different electrodes and conductive strips on the first set $S_{1a}$ and $S_{1b}$ of surfaces towards their line of intersection where an elongated orifice was placed through which the charged particles of the formed elongated cloud of charged particles can be accelerated towards the second set $S_{2a}$ and $S_{2b}$ of surfaces where the charged particles are pushed by the DC-electric potentials on the electrodes and conductive surfaces on the second set $S_{2a}$ and $S_{2b}$ of surfaces towards their line of intersection such that the elongated cloud of charged particles is compressed to an overall small cross section provided that the two lines of intersection form an angle with each other that does not deviate too much from 90°.

18. A charged-particle condensing device according to claim 17 characterized by the fact that at least one of the angles $\Delta\Phi_1$ or $\Delta\Phi_2$ is zero.

19. A charged-particle condensing device according to claim 17 characterized by the fact that each of said surfaces $S_{1a}$ and $S_{1b}$ is divided into at least two substantially flat subsurfaces $S_{1a1}$ and $S_{1a2}$ as well as $S_{1b1}$ and $S_{1b2}$ which are inclined relative to each other such that their intersection line is substantially parallel to the electrodes or conductive strips and/or each of said surfaces $S_{2a}$ and $S_{2b}$ is divided into at least two flat subsurfaces $S_{2a1}$ and $S_{2a2}$ as well as $S_{2b1}$ and $S_{2b2}$ which are inclined relative to each other such that their intersection line is substantially parallel to the electrodes or conductive strips.

20. A charged-particle condensing device according to claim 17 characterized by the fact that at least one of said surfaces $S_{1a}$ and $S_{1b}$ and/or $S_{2a}$ and $S_{2b}$ are substantially planes.

21. A charged-particle condensing device according to claim 16 characterized by the fact that to said set of substantially flat surfaces $S_{1a}$ and $S_{1b}$ inclined relative to each other by $\Delta\Phi_1$ a separate surface is added on which electrodes or conductive strips are placed that are substantially circular and substantially concentric in which case the charged particles that had been pushed by the DC-electric potentials of the electrodes and conductive surfaces on the first set $S_{1a}$ and $S_{1b}$ of surfaces towards their line of intersection where an elongated orifice was placed through which the charged particles can be accelerated towards the surface on which electrodes or conductive strips are placed that are substantially circular and substantially concentric where the charged particles are pushed radially by the DC-electric potentials on the ring electrodes or conductive strips such that the initially elongated cloud of charged particles is compressed to an overall small cross section.

22. A charged-particle condensing device according to claim 16 characterized by the fact that the angle $\Delta\Phi_1$ is zero.

23. A charged-particle condensing device according to claim 16 characterized by the fact that the electrodes or conductive strips are formed in the technique of printed circuit boards and the RF- and DC-potentials are applied to the electrodes through vias whose diameter must stay smaller than twice the repetition length, i.e. the sum of the width of one electrode or conductive strip plus the separation from the next electrode.

24. A charged-particle condensing device according to claim 16 characterized by the fact that the substantially parallel arranged electrodes or conductive strips are formed in the technique of printed circuit boards with the RF- and DC-potentials being applied in the plane of the electrodes or conductive strips directly through leads from the electric supply circuit.

25. A charged-particle condensing device according to claim 16 characterized by the fact that the electrodes or conductive strips are formed in the technique of printed circuit boards with the substantially parallel arranged electrodes or conductive strips being connected such as to form two intertwined meanders with the RF-voltages being applied between the two meanders and the DC-potentials along each of the meanders being formed by applying to both ends of each meander appropriate DC-potentials and building the electrodes or conductive strips from high-resistivity material.

26. A charged-particle condensing device according to claim 16 characterized by the fact that the electrodes or conductive strips are formed in the technique of printed circuit boards with the substantially parallel arranged electrodes or conductive strips being connected such as to form two intertwined meanders formed on the front-side as well as on the back-side of a thin printed circuit board with the meanders on the back-side of the printed circuit board comprising well conductive material and the meanders on the front-side of the printed circuit board comprising high-resistivity material in which case the DC-potentials along each meander are formed by applying appropriate DC-potentials to both ends of each of the front-side meanders while the RF-voltages are applied between the two back-side meanders in which case the RF-potentials are capacitively coupled to the meanders on the front side.

27. A charged-particle condensing device according to claim 16 characterized by the fact that the electrodes or conductive strips are formed in the technique of printed circuit boards with the substantially parallel arranged electrodes or conductive strips being connected such as to form N=3, 4, . . . intertwined meanders with the RF-voltages being applied to neighboring meanders at phase differences of substantially 360°/N and the DC-potentials along each meander being formed by applying to both ends of each meander appropriate DC-potentials and building the electrodes or conductive strips from high-resistivity material.

28. A charged-particle condensing device according to claim 16 characterized by the fact that the electrodes or conductive strips are formed in the technique of printed circuit boards with the substantially parallel arranged electrodes or conductive strips being connected such as to form N=3, 4, . . . intertwined meanders on the front-side as well as on the back-side of a thin printed circuit board, with the meanders on the back-side of the printed circuit board comprising well conductive material and the meanders on the front-side of the printed circuit board comprising high-resistivity material in which case the DC-potentials along each of the meanders are formed by applying appropriate DC-potentials to both ends of each of the front-side meanders while the RF-voltages are applied to neighboring back-side meanders with phase differences of substantially 360°/N when going from one meander to the next in which case the RF-potentials are capacitively coupled to the high-resistivity meanders on the front side.

29. A charged-particle condensing device according to claim 28 characterized by the fact that the DC-potentials are zero and the frequency is adjusted to the speed of the particle motion.

30. A charged-particle condensing device according to claim 27 characterized by the fact that the DC-potentials are zero and the frequency is adjusted to the speed of the particle motion.

31. A charged-particle condensing device according to claim 30 characterized by the fact that the RF-voltage are chosen such that a potential depression is formed that moves from meander-1 to meander-2 to meander-3 to . . . to meander-N and pulls charged particles in a direction that is substantially perpendicular to the elongated electrodes thus forming a narrow but elongated cloud of charged particles.

32. A charged-particle condensing device according to claim 16 characterized by the fact that the axis of the initial charged-particle plume is directed to not meet the line of intersection of the surfaces that carry electrodes or conductive surface strips that are substantially parallel to this line of intersection with this axis shift being achieved by laterally shifting the initial cloud of charged-particles or by tilting its main direction of motion.

33. A charged-particle condensing device according to claim 16 characterized by the fact that the electrodes are formed as insulated but conductive stretched wires whose surfaces are bare conductive surfaces or conductive surfaces covered by a thin layer of a dielectric.

34. A charged-particle condensing device according to claim 1 characterized by the fact that between the initial cloud of charged particles and the first surface on which electrodes or conductive strips are placed at least one grid is placed whose potential reduces the velocity of charged particles when they approach said surface to a level that the RF repelling force of the electrode or conductive strip array suffices to repel them from said surface.

35. A charged-particle condensing device according to claim 1 characterized by the fact that between the initial cloud of charged particles and the first surface on which electrodes or conductive strips are placed at least one diaphragm is placed whose potential reduces the velocity of the charged particles s when they approach said surface to a level that the RF repelling force of the electrode or conductive strip array suffices to repel the charged particles from said surface.

36. A charged-particle condensing device according to claim 1 characterized by the fact that the amplitudes of the RF-voltages are reduced to some experimentally determined value such that only charged particles that are heavier than a certain limiting mass are hovering above the electrodes or conductive strips.

37. A charged-particle condensing device according to claim 1 characterized by the fact that the electrodes are formed as conductive strips formed in the technique of printed circuit boards with these conductive strips having bare conductive surfaces or conductive surfaces covered by a thin layer of a dielectric.

* * * * *